US009447725B2

(12) United States Patent
Okada et al.

(10) Patent No.: US 9,447,725 B2
(45) Date of Patent: Sep. 20, 2016

(54) COMPRESSOR AND VACUUM MACHINE

(71) Applicant: SHINANO KENSHI CO., LTD., Ueda-shi, Nagano (JP)

(72) Inventors: Eiji Okada, Nagano (JP); Kazuhiro Ueda, Nagano (JP)

(73) Assignee: SHINANO KENSHI CO., LTD., Ueda-shi (JP)

( * ) Notice: Subject to any disclaimer, the term of this patent is extended or adjusted under 35 U.S.C. 154(b) by 143 days.

(21) Appl. No.: 13/773,071

(22) Filed: Feb. 21, 2013

(65) Prior Publication Data

US 2013/0251564 A1 Sep. 26, 2013

(30) Foreign Application Priority Data

Mar. 23, 2012 (JP) ..... 2012-068216

(51) Int. Cl.

| | |
|---|---|
| ***F02B 63/06*** | (2006.01) |
| ***F04B 35/04*** | (2006.01) |
| ***F04B 35/06*** | (2006.01) |
| *F04B 39/06* | (2006.01) |

(52) U.S. Cl.

CPC ..... *F02B 63/06* (2013.01); *F04B 35/04* (2013.01); *F04B 35/06* (2013.01); *F04B 39/06* (2013.01)

(58) Field of Classification Search

CPC .. F04B 35/06; F04B 39/0094; F04B 39/066; F02B 63/06

USPC ..... 417/366, 368, 372, 415, 269, 271, 273, 417/313, 423.1, 423.8

See application file for complete search history.

(56) References Cited

U.S. PATENT DOCUMENTS

| | | | | |
|---|---|---|---|---|
| 1,470,548 | A | 10/1923 | Gregory | |
| 1,677,539 | A | 7/1928 | Wollman | |
| 2,337,582 | A | 12/1943 | Wineman | |
| 2,364,111 | A | 12/1944 | Tucker | |
| 2,668,004 | A | 2/1954 | Browne | |
| 2,775,426 | A | 12/1956 | Barrett, Jr. | |
| 3,839,946 | A | 10/1974 | Paget | |
| 4,190,402 | A | 2/1980 | Meece et al. | |
| 4,350,475 | A | 9/1982 | Meece et al. | |
| 4,689,509 | A | 8/1987 | Kumatani et al. | |
| 5,230,616 | A | 7/1993 | Serizawa et al. | |
| 5,800,888 | A | 9/1998 | Yasumoto et al. | |
| 6,364,632 | B1 * | 4/2002 | Cromm et al. | 417/372 |

(Continued)

FOREIGN PATENT DOCUMENTS

| | | | |
|---|---|---|---|
| CA | 2298051 | A1 | 8/2000 |
| CN | 101594013 | A | 12/2009 |

(Continued)

OTHER PUBLICATIONS

Office Action issued in Japanese Patent Application No. 2012-068216 mailed Feb. 12, 2014 (with translation).

(Continued)

*Primary Examiner* — Patrick Hamo
(74) *Attorney, Agent, or Firm* — Oliff PLC

(57) ABSTRACT

A compressor includes: a cylinder; a crankcase; a piston arranged within the cylinder and the crankcase; and an outer rotor type motor causing the piston to reciprocate, wherein the outer rotor type motor comprises: a stator; a coil wound around the stator; a rotational shaft; a yoke connected with the rotational shaft; and a permanent magnet secured to the yoke, and the yoke is formed with an air hole.

10 Claims, 8 Drawing Sheets

(56) References Cited

U.S. PATENT DOCUMENTS

| | | | |
|---|---|---|---|
| 7,616,440 | B2 | 11/2009 | Franz |
| 2002/0012592 | A1 | 1/2002 | Nishikawa et al. |
| 2004/0042917 | A1 | 3/2004 | Chang et al. |
| 2004/0070267 | A1 | 4/2004 | Volz et al. |
| 2005/0120993 | A1 | 6/2005 | Utsumi et al. |
| 2005/0150725 | A1 | 7/2005 | Utsumi et al. |
| 2007/0035197 | A1 | 2/2007 | Usui |
| 2009/0194177 | A1 | 8/2009 | Yokota et al. |
| 2009/0246042 | A1 | 10/2009 | Otsubo |
| 2009/0290998 | A1 | 11/2009 | Tabata et al. |
| 2010/0074772 | A1 | 3/2010 | Hoshino et al. |
| 2010/0303645 | A1 | 12/2010 | Ohata et al. |
| 2011/0256001 | A1 | 10/2011 | Kobayashi et al. |
| 2012/0003097 | A1 | 1/2012 | Cho et al. |
| 2013/0251564 | A1 | 9/2013 | Okada et al. |

FOREIGN PATENT DOCUMENTS

| | | | |
|---|---|---|---|
| CN | 201854156 | U | 6/2011 |
| CN | 102220957 | A | 10/2011 |
| DE | 102008000124 | A1 | 7/2009 |
| DE | 10 2010 051 262 | A1 | 5/2012 |
| JP | U-57-21266 | | 2/1982 |
| JP | U-59-8280 | | 1/1984 |
| JP | 62-156191 | A | 7/1987 |
| JP | S62-156191 | U | 10/1987 |
| JP | U-62-178777 | | 11/1987 |
| JP | H07-63167 | A | 3/1995 |
| JP | H07-75301 | A | 3/1995 |
| JP | H108-61235 | A | 3/1996 |
| JP | A-8-338369 | | 12/1996 |
| JP | h109-84285 | A | 3/1997 |
| JP | 2000-257557 | A | 9/2000 |
| JP | 2000-320458 | A | 11/2000 |
| JP | 2000-337258 | A | 12/2000 |
| JP | 2001-244110 | A | 9/2001 |
| JP | 2001-263247 | A | 9/2001 |
| JP | 2002-371962 | A | 12/2002 |
| JP | 2004-183498 | A | 7/2004 |
| JP | A-2004-183498 | | 7/2004 |
| JP | A-2004-274907 | | 9/2004 |
| JP | 2005-042595 | A | 2/2005 |
| JP | 2005-315251 | A | 11/2005 |
| JP | 2007-205207 | A | 8/2007 |
| JP | 2008031889 | A | 2/2008 |
| JP | 2008-106694 | A | 5/2008 |
| JP | A-2008-154369 | | 7/2008 |
| JP | 2009-013790 | A | 1/2009 |
| JP | 2009-185707 | A | 8/2009 |
| JP | 2011-144741 | A | 7/2011 |
| JP | 2011-220287 | A | 11/2011 |
| JP | 5049673 | B2 | 10/2012 |

OTHER PUBLICATIONS

Feb. 2, 2016 Office Action issued in Chinese Patent Application No. 201310093452.4.
Jan. 30, 2015 Office Action issued in U.S. Appl. No. 13/680,601.
Sep. 10, 2015 Office Action issued in U.S. Appl. No. 13/680,601.
Jan. 6, 2016 Office Action issued in U.S. Appl. No. 13/680,601.
Mar. 22, 2016 Office Action Issued in U.S. Appl. No. 13/899,924.
Aug. 28, 2015 Office Action issued in Chinese Patent Application No. 201210595777.8.
May 18, 2016 Office Action Issued in U.S. Appl. No. 13/680,601.
Jan. 7, 2014 Office Action issued in Japanese Application No. 2013-005703.
Oct. 29, 2013 Office Action issued in Japanese Application No. 2013-005703.
U.S. Appl. No. 13/759,159, filed Feb. 5, 2013 in the name of Okada et al.
U.S. Appl. No. 13/899,924, filed May 22, 2013 in the name of Okada et al.
Nov. 20, 2015 Office Action issued in U.S. Appl. No. 13/759,159.
Jul. 13, 2015 Office Action issued in U.S. Appl. No. 13/759,159.
Mar. 6, 2015 Office Action issued in U.S. Appl. No. 13/759,159.
U.S. Appl. No. 13/680,601, filed Nov. 19, 2012 in the name of Okada et al.
Mar. 21, 2012 Office Action issued in Japanese Patent Application No. 2012-011348.
Jun. 26, 2012 Office Action issued in Japanese Patent Application No. JP2012-011348.
Jun. 15, 2016 Office Action issued in U.S. Appl. No. 13/759,159.

* cited by examiner

COMPRESSOR AND VACUUM MACHINE

CROSS-REFERENCE TO RELATED APPLICATION

This application is based upon and claims the benefit of priority of the prior Japanese Patent Application No. 2012-068216, filed on Mar. 23, 2012, the entire contents of which are incorporated herein by reference.

BACKGROUND (i) Technical Field

The present invention relates to a compressor and a vacuum machine.

(ii) Related Art

There is known a compressor and a vacuum machine which compress and discharge intake air by a piston which reciprocates within a cylinder by a motor. Japanese Patent Application Publication No. 2004-183498 discloses such a compressor.

The temperature of the motor, which is used for such a compressor or a vacuum machine, increases, when the motor drives. When the temperature of the motor increases, the heat is transferred to the cylinder, so the temperature thereof increases. Thus, for example, the piston might wear to adversely influence parts and the life of the compressor itself or the vacuum machine itself.

Also, air is adiabatically compressed within the cylinder, so that the temperature of the adiabatically compressed air becomes high. Thus, the compressor or the vacuum machine might be continuously used while heating up. In this case, for example, the piston wears to adversely influence parts and the life of the compressor itself or the vacuum machine itself. Also, there is a case where the compressed air blew a catalyst to react, depending on a device supplied with the compressed air. In such a case, when the compressed air temperature is high, the reaction of the catalyst might not proceed.

Japanese Patent Application Publication No. 2004-183498 discloses a fan for cooling the compressor is arranged in an axial direction of a motor. However, there is a problem with the large height in the axial direction. Further, in Japanese Patent Application Publication No. 2004-183498, an inner rotor type motor is used. Thus, there is another problem that the inner rotor type motor has a torque smaller than that of an outer rotor type motor having the same size as the inner rotor type motor.

SUMMARY

According to an aspect of the present invention, there is provided a compressor including: a cylinder; a crankcase; a piston arranged within the cylinder and the crankcase; and an outer rotor type motor causing the piston to reciprocate, wherein the outer rotor type motor comprises: a stator; a coil wound around the stator; a rotational shaft; a yoke connected with the rotational shaft; and a permanent magnet secured to the yoke, and the yoke is formed with an air hole.

According to another aspect of the present invention, there is provided a vacuum machine including: a cylinder; a crankcase; a piston arranged within the cylinder and the crankcase; and an outer rotor type motor causing the piston to reciprocate, wherein the outer rotor type motor comprises: a stator; a coil wound around the stator; a rotational shaft; a yoke connected with the rotational shaft; and a permanent magnet secured to the yoke, and the yoke is formed with an air hole.

DETAILED DESCRIPTION

Plural embodiments will be described.

[First Embodiment]

Figure 1:
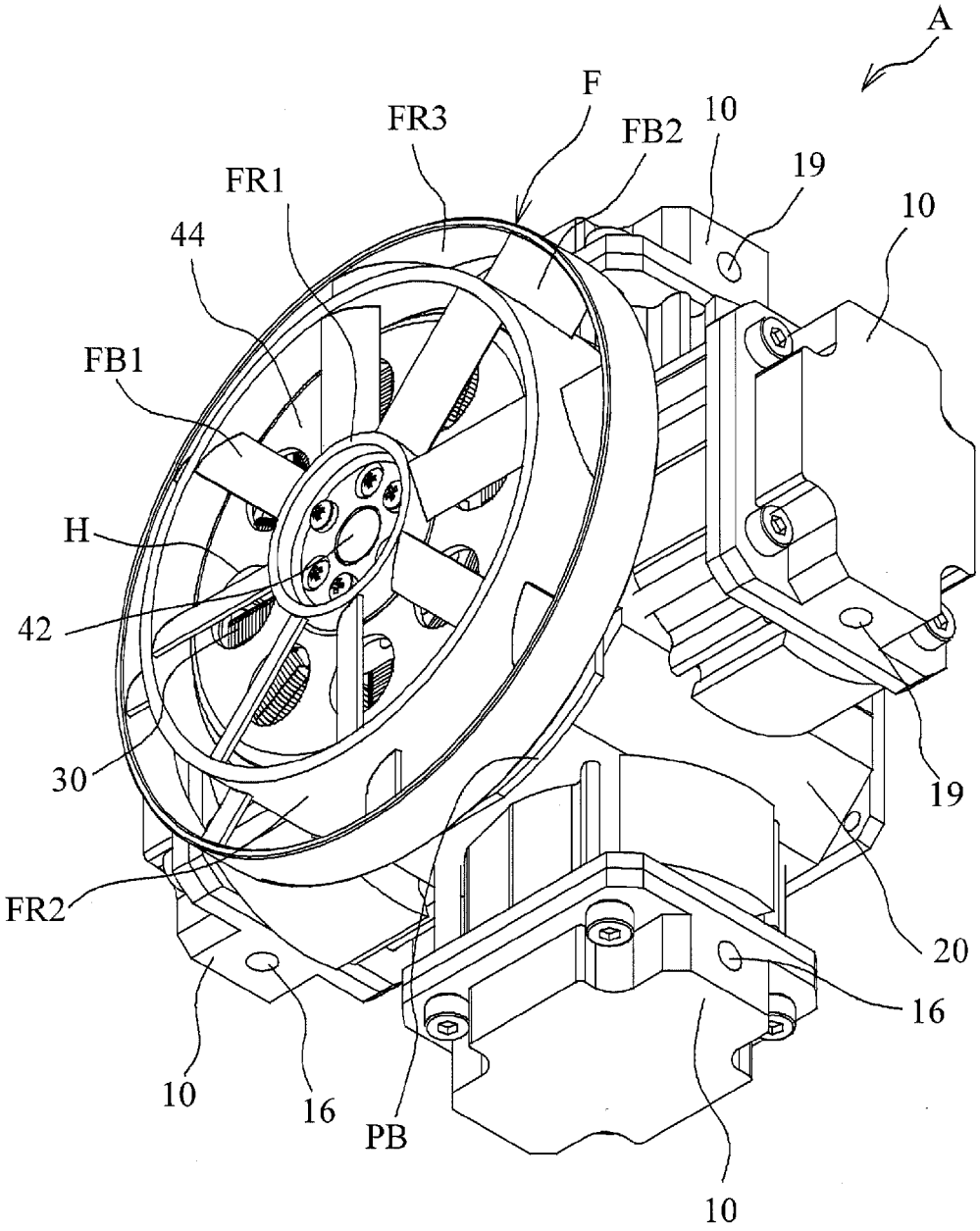
FIG. 1 is an external view of a compressor according to a first embodiment.

FIG. 1 is an external view of a compressor A according to a first embodiment. Additionally, when the object device is connected at the intake side of the compressor A or when a check valve is arranged in a manner opposite to a manner of the compressor A, the compressor A acts as a vacuum machine. The compressor A includes: four cylinders 10; a crankcase 20 attached with the four cylinders 10; a motor arranged at the upper side of the crankcase 20; and a fan F attached with the motor. The fan F is rotated in conjunction with the rotation of the motor. The four cylinders 10 are attached to the outer circumference of the crankcase 20. As illustrated in FIG. 1, the cylinders 10 are radially arranged about the rotational shaft 42 at even intervals. The rotational shaft 42 is a rotational shaft of the motor.

The fan F faces at least parts of the cylinders 10. The rotation of the fan F can cool the cylinders 10 and the crankcase 20. The fan F will be described later in detail. A piston reciprocates within the cylinder 10 and the crankcase 20. The cylinders 10 and the crankcase 20 are made of metal such as aluminum having a good heat radiation characteristic.

Figure 2:
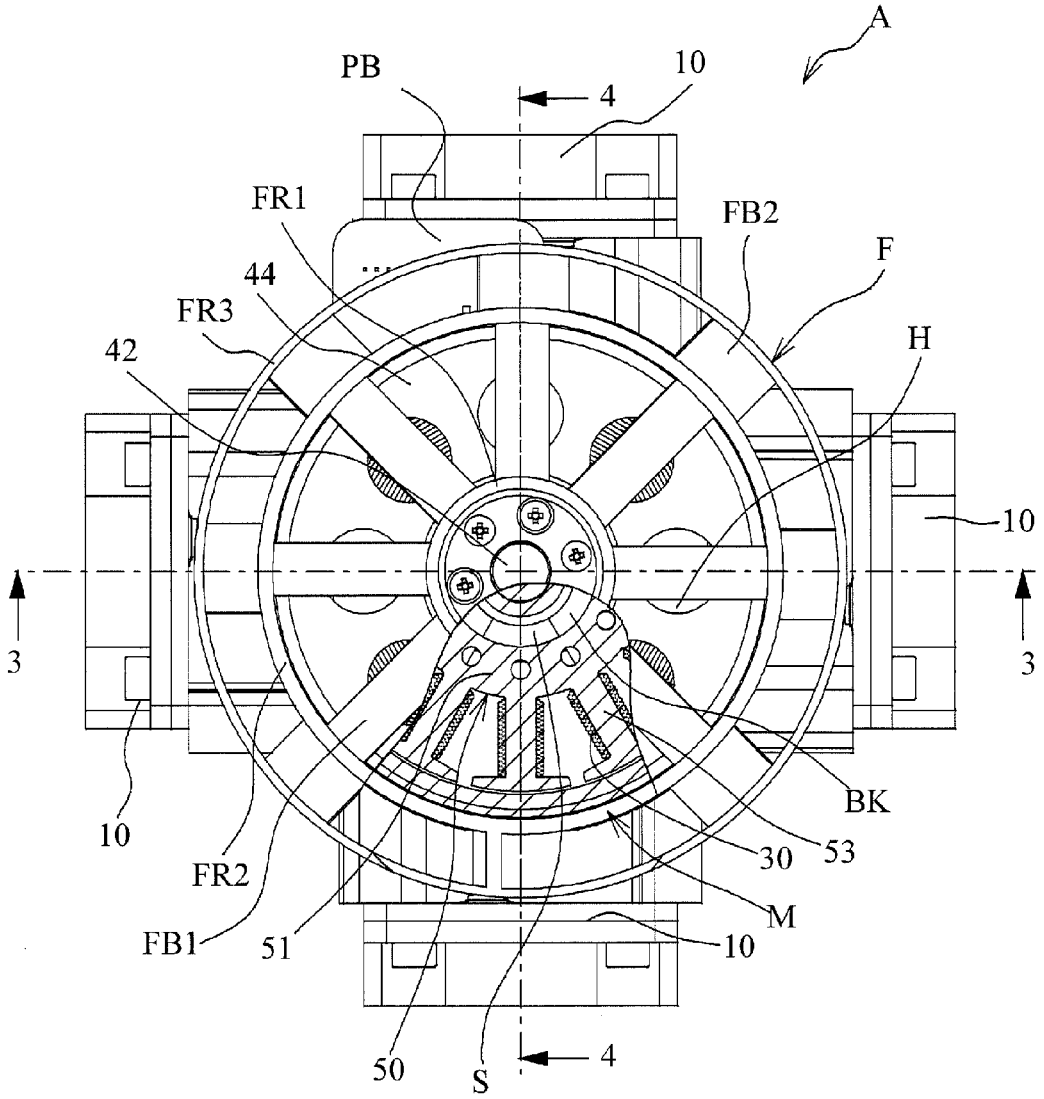
FIG. 2 is a front view partially illustrating an inner side of a motor of the compressor.
Figure 3:
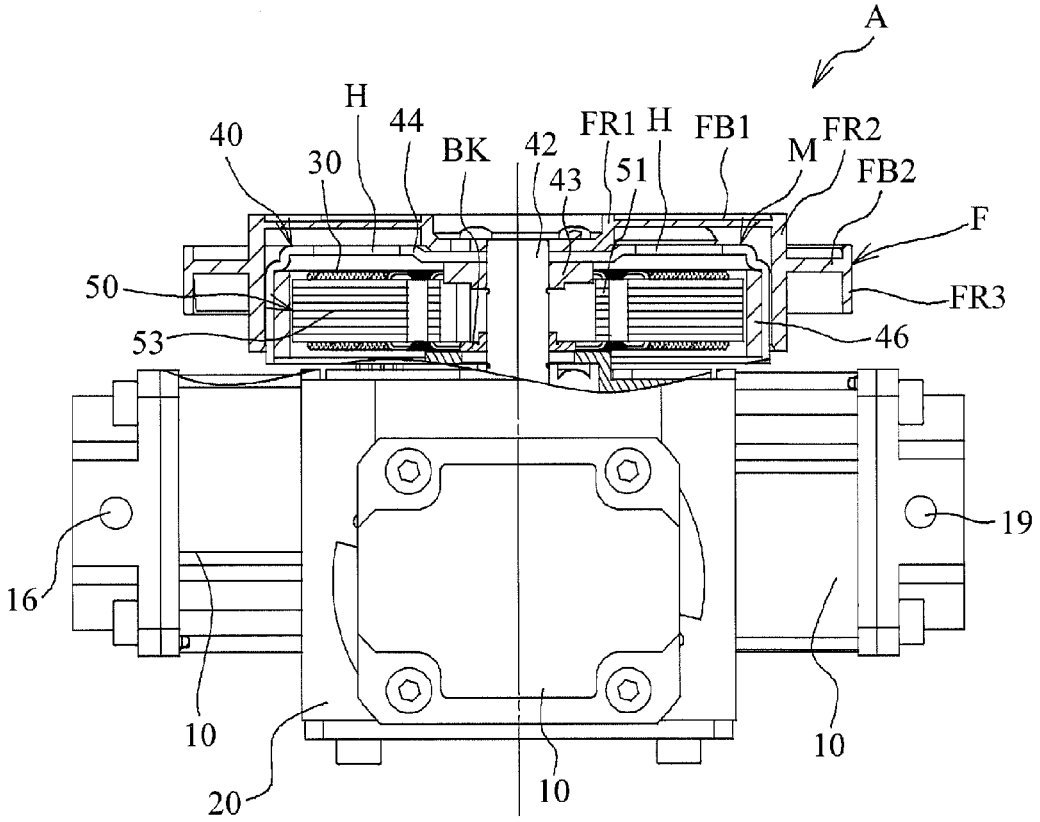
FIG. 3 is a sectional view taken along line 3-3 of FIG. 2.

FIG. 2 is a front view partially illustrating an inner side of a motor M of the compressor A. FIG. 3 is a sectional view taken along line 3-3 of FIG. 2. Firstly, the motor M will be described. The motor M includes: coils 30, a rotor 40, a stator 50, and a printed circuit board PB. The stator 50 is made of metal. The stator 50 is secured to the crankcase 20. The plural coils 30 are wound around the stator 50. The coils 30 are electrically connected with the printed circuit board PB. As for the printed circuit board PB, conductive patterns are formed on an insulating board having rigidity. A non-illustrated power supply connector for supplying power to the coils 30, a signal connector, and other electronic parts are mounted on the printed circuit board PB. The coils 30 are energized, so the stator 50 is energized.

The rotor 40 includes: a rotational shaft 42; a yoke 44; and one or plural permanent magnets 46. The rotational shaft 42 is rotationally supported by plural bearings arranged within the crankcase 20. The yoke 44 is secured to the rotational shaft 42 through a hub 43, so the yoke 44 rotates together with the rotational shaft 42. The yoke 44 has a substantially cylindrical shape and is made of metal. One or plural permanent magnets 46 are secured to the inner circumferential side of the yoke 44. The permanent magnets 46 face the outer circumferential surface of the stator 50. The coils 30 are energized, so the stator 50 is energized. Thus, the magnetic attractive force and the magnetic repulsive force are generated between the permanent magnets 46 and the stator 50. This magnetic force allows the rotor 40 to rotate with respect to the stator 50. As mentioned above, the motor M is an outer rotor type motor in which the rotor 40 rotates.

As illustrated in FIG. 2, the stator 50 includes: a circle portion 51; and plural tooth portions 53 radially extending from the circle portion 51 at even intervals. The coils 30 are wound around the tooth portions 53, respectively. Further, as illustrated in FIG. 2, the circle portion 51 of the stator 50 is fitted with a bracket BK which is integrally or separately provided in the crankcase 20. The bracket BK is an example of a fitting portion. A cutout portion S is formed at a part of this bracket BK. Herein, the stator 50 is located between the yoke 44 and the crankcase 20. Thus, the cutout portion S permits air to flow between the yoke 44 and the crankcase 20.

The fan F generally includes ring portions FR1, FR2, and FR3, each of which has a substantially cylindrical shape. The ring portions FR1 to FR3 are formed concentrically with one another. Plural blades FB1 are formed between the ring portions FR1 and FR2. Plural blades FB2 are formed between the ring portions FR2 and FR3. The blades FB1 face the yoke 44, and the blade FB2 face at least parts of the cylinders 10. The ring portion FR2 of the fan F is secured to the yoke 44 of the rotor 40 by, for example, press fitting, adhesive bonding, or screw fixing the fan F with the hub 43 of the rotor 40. Specifically, the inside of the ring portion FR2 is fitted with the outside of the yoke 44. The fan F is made of resin.

Figure 4:
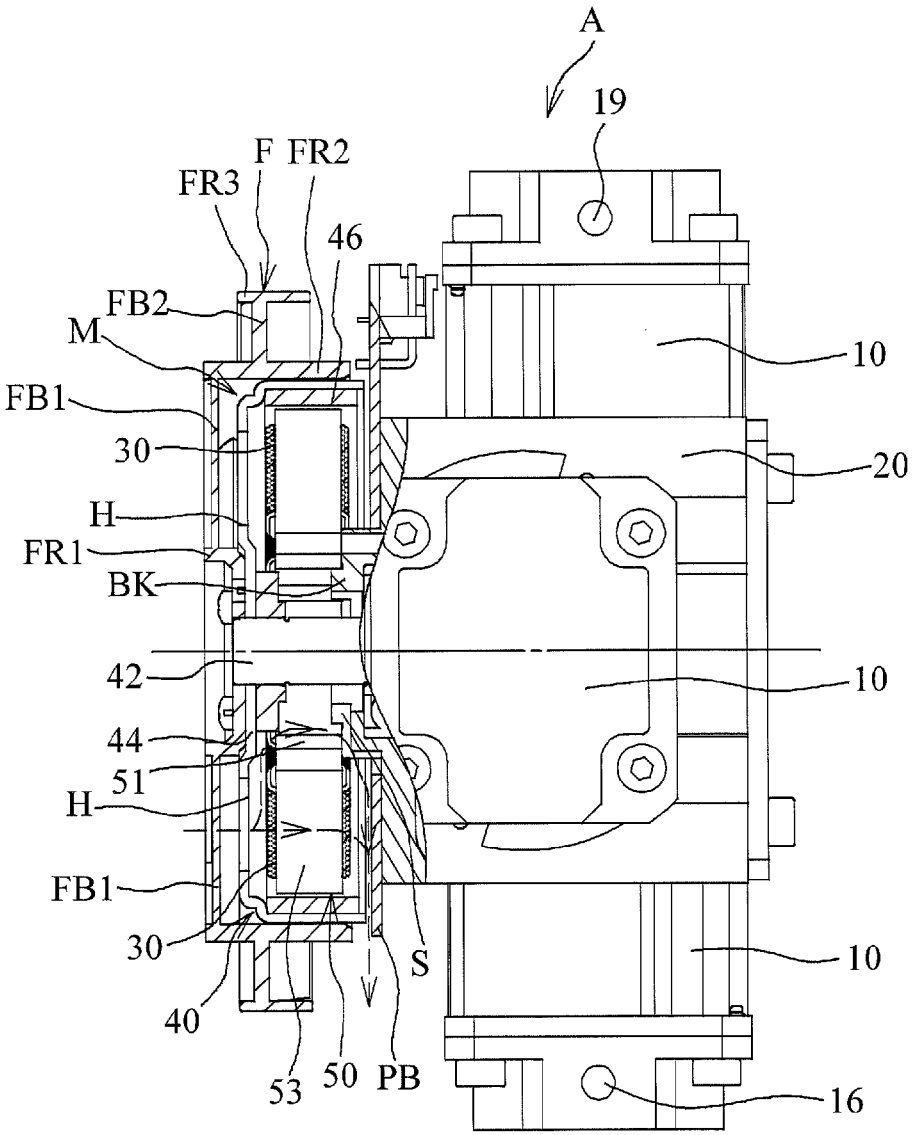
FIG. 4 is a sectional view taken along line 4-4 of FIG. 2.

FIG. 4 is a sectional view taken along line 4-4 of FIG. 2. Plural air holes H are formed in the yoke 44. The plural air holes H are formed around the rotational shaft 42 at even intervals, but the present embodiment is not limited to these arrangements. Also, the air hole H has a circular shape, but the present embodiment is not limited to this. The rotation of the fan F assists air in flowing through the plural air holes H. Specifically, the blades FB1 of the fan F, which face the plural air holes H, assists air in flowing through the plural air holes H. The fan F is an example of an inside fan. FIG. 4 illustrates an arrow indicating air flowing into the motor M when the fan F rotates. The air, which has flowed into the motor M through the air holes H, flows between the adjacent tooth portions 53 and flows through the cutout portion S of the bracket BK toward the printed circuit board PB, the cylinders 10, and the crankcase 20. Herein, the coils 30 are energized while the motor M is driving, so the temperature of the coils 30 increases. Therefore, the whole motor M might become hot. Air flows through the air holes H into the motor M as mentioned above, thereby cooling the coils 30 and the whole motor M. Further, the air, which has flowed into the motor M, flows toward the cylinders 10 and the crankcase 20, thereby cooling the cylinders 10 and the crankcase 20.

Additionally, the pistons, which respectively arranged within the cylinders 10, are connected with the rotational shaft 42. Thus, the pistons reciprocate in response to the rotation of the motor M, so the capacities of chambers in the cylinders increase or decrease. Each of the cylinder 10 is formed with an inlet port 16 and an outlet port 19. Air is introduced into the chamber of the cylinder 10 through the inlet port 16, the air is compressed by the piston, and the compressed air is discharged from the outlet port 19. The inlet port 16 and the outlet port 19 are connected with, for example, tubes, respectively.

Herein, the capacity of the chamber increases or decreases to adiabatically compress the air within the chamber, so that the temperature of the air increases. Also, the piston slides on an inner surface of a wall of the cylinder 10, whereby the temperature of the cylinder 10 and the piston is increased by friction. However, in the present embodiment, the fan F is provided, thereby suppressing the temperature of the compressor A from increasing.

As illustrated in FIG. 4, the fan F and the motor M are arranged in the radial direction of the fan F when viewed from the cross section including the axis of the motor M. Specifically, the fan F, the coils 30, the rotor 40, and the stator 50 are arranged in the radial direction of the fan F. Thus, for example, as compared with a case where the fan F is arranged at the end of the motor M in the axial direction (the upper side in FIG. 4) and is secured to the front end of the rotational shaft, the compressor A according to the present embodiment has a reduced thickness in the axial direction. Further, the fan F is close to the cylinder 10, thereby improving the cooling effects. Fan F is an example of an outside fan.

Also, in a case where the fan F is arranged at the end of the motor M in the axial direction and is secured to the front end of the rotational shaft, the rotational shaft has to be long. If the rotational shaft is long, it is necessary to provide a large bearing or plural bearings in order to support the rotation of the rotational shaft. In the compressor A according to the present embodiment, the short rotational shaft 42 is employed, thereby supporting the rotational shaft 42 by a small bearing or few bearings. Therefore, the whole weight of the compressor A is reduced.

Therefore, the fan F can cool the cylinders 10, the crankcase 20, and the motor M. Thus, it is not necessary to provide fans respectively cooling these parts, unlike a device using a conventional compressor or a conventional vacuum machine. Thus, as for the compressor A or a vacuum machine according to the present embodiment, the number of the parts is reduced and the manufacturing cost is reduced.

Also, the motor M is the outer rotor type motor. The outer rotor type motor has a torque higher than that of an inner rotor type motor, providing that they have the same size. This suitably moves the pistons.

Additionally, in the present embodiment, the fan F rotates in the opposite direction, so air flows in the direction opposite to the direction illustrated in FIG. 4. In such a case, the motor M, the cylinders 10, and the crankcase 20 can be cooled. Additionally, the fan F is formed by integrally forming the inside fan and the outside fan. However, the inside fan and the outside fan may be separately formed. Also, only one of the inside fan and the outside fan may be provided. Also, the fan F may not be provided.

[Second Embodiment]

Figure 5:
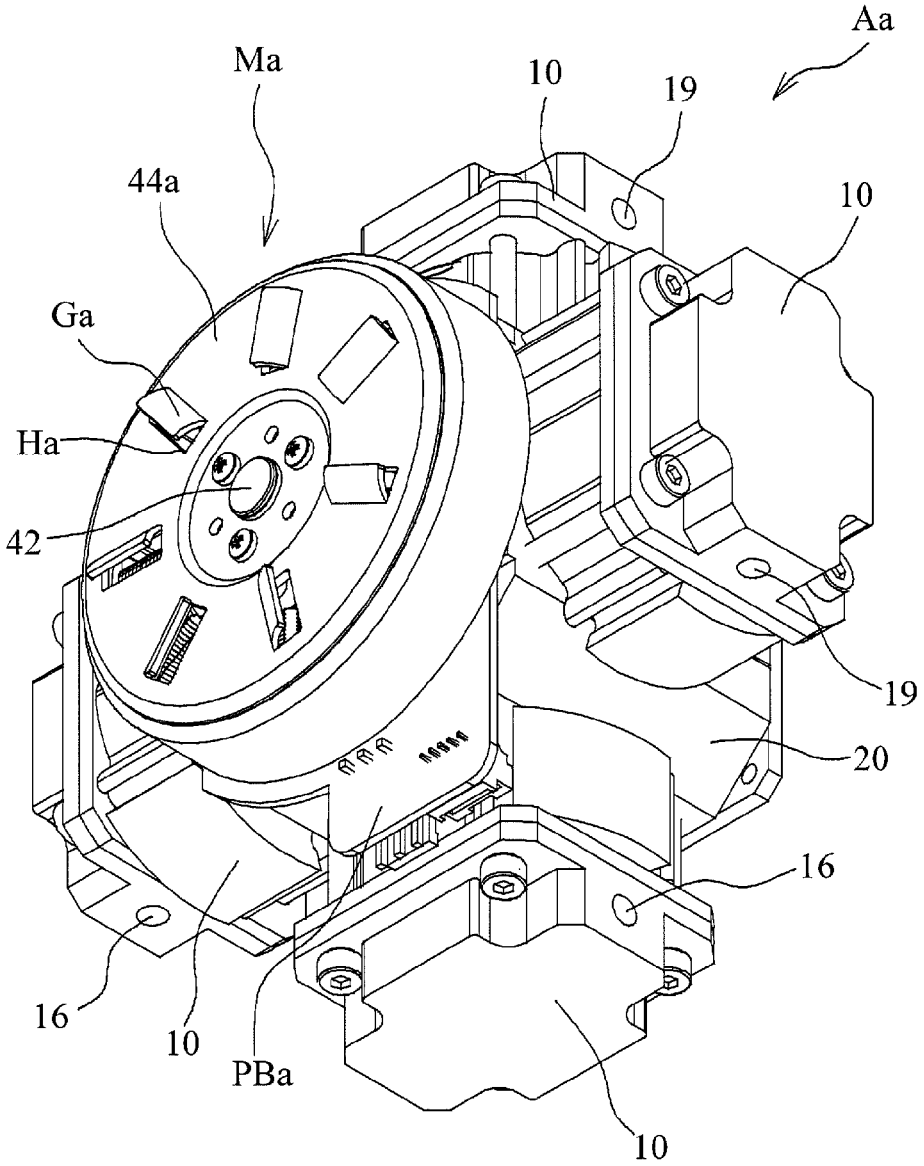
FIG. 5 is an external view of a compressor according to a second embodiment.
Figure 6:
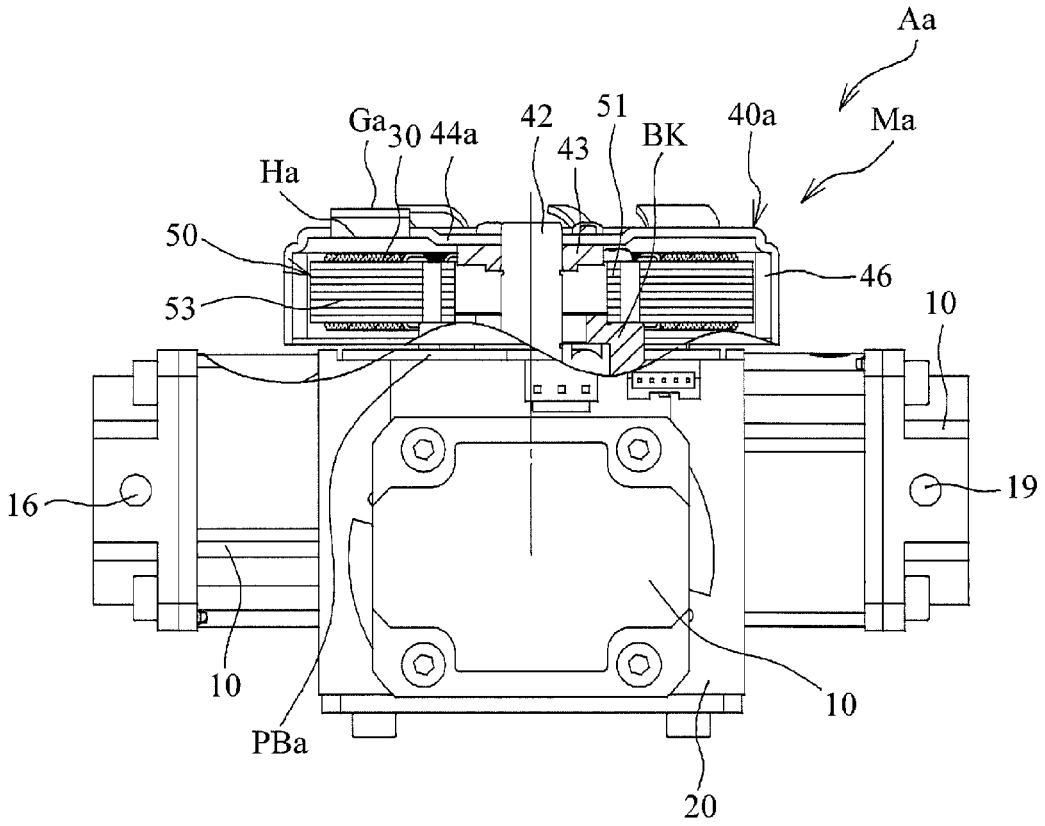
FIG. 6 is a sectional view of the compressor according to the second embodiment.

A compressor Aa according to a second embodiment will be described. Additionally, similar components of the compressor A according to the first embodiment are designated with similar reference numerals and a description of those components will be omitted. FIG. 5 is an external view of the compressor Aa according to the second embodiment. FIG. 6 is a sectional view of the compressor Aa according to the second embodiment.

The compressor Aa according to the second embodiment is not provided with the fan F, unlike the first embodiment. However, a yoke 44*a* is formed with guide portions Ga, which are arranged near air holes Ha, respectively. The guide portion Ga is formed to stand up from the edge of the air hole Ha. The guide portion Ga protrudes toward the opposite side of the stator 50. The yoke 44*a* is made of metal, and the air holes Ha and the guide portions Ga are formed by press working. When a motor Ma drives, the yoke 44*a* rotates. This also rotates the guide portions Ga, thereby assisting air in flowing through the air holes Ha. Such a configuration can cool the motor Ma and the cylinders 10, and the crankcase 20.

Further, although the present embodiment is not provided with the fan F, the guide portions Ga formed in the yoke 44*a* can cool not only the motor Ma but also the cylinders 10 and the crankcase 20. Therefore, this configuration is thin, as compared with a case where a fan for cooling the cylinders 10 and the crankcase 20 is provided in the axial direction of the motor Ma. Also, the number of parts is reduced. Moreover, the second embodiment may be provided with the fan F. In this case, the cylinders 10 and the crankcase 20 can be further cooled. Also, only one of the inside fan and the outside fan may be provided. Both the inside fan and the outside fan separately formed may be provided.

Additionally, like the first embodiment, the stator 50 of the motor Ma is supported by and fitted with the bracket BK of the crankcase 20, and air flows into the cylinders 10 and the crankcase 20 through the cutout portion S formed in the bracket BK.

[Third Embodiment]

Figure 7:
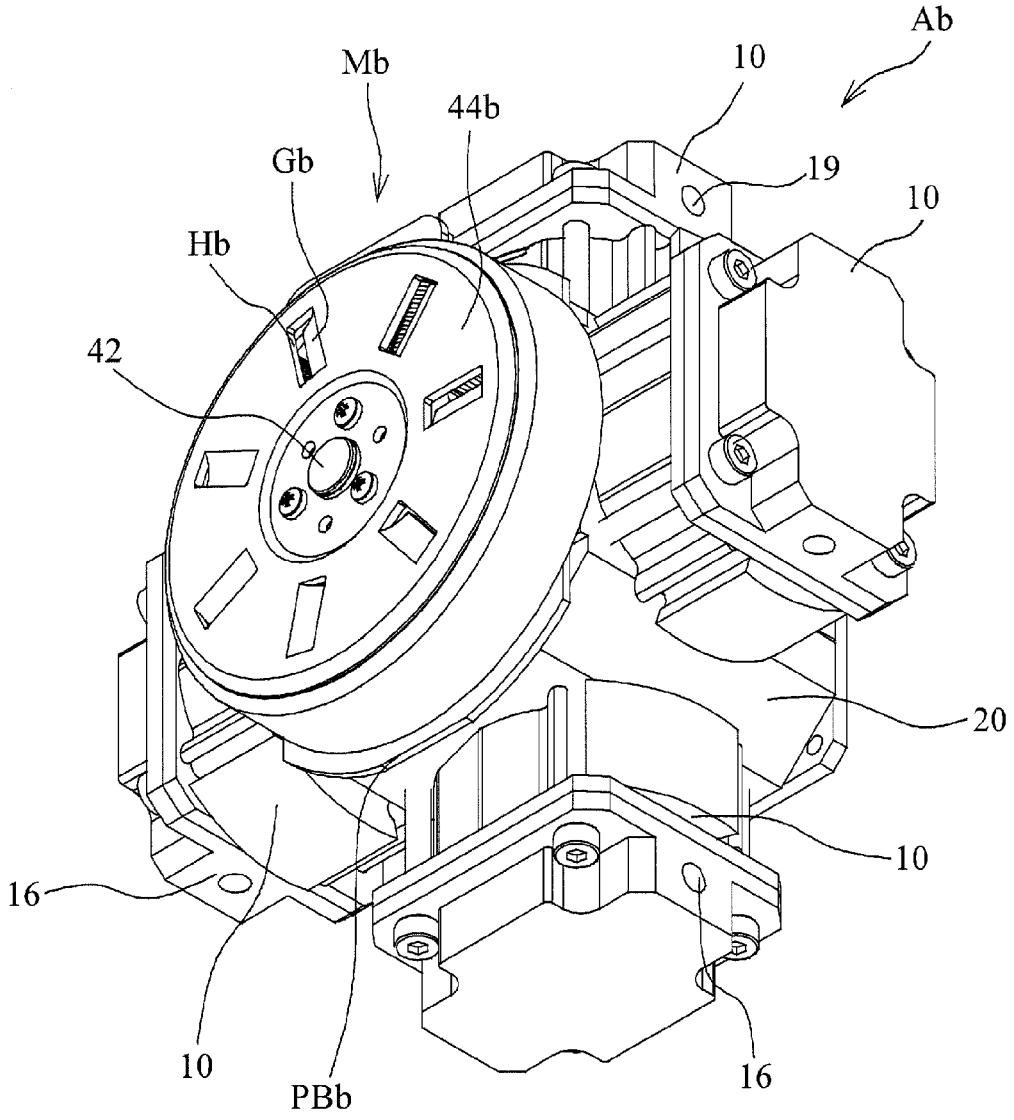
FIG. 7 is an external view of a compressor according to a third embodiment.
Figure 8:
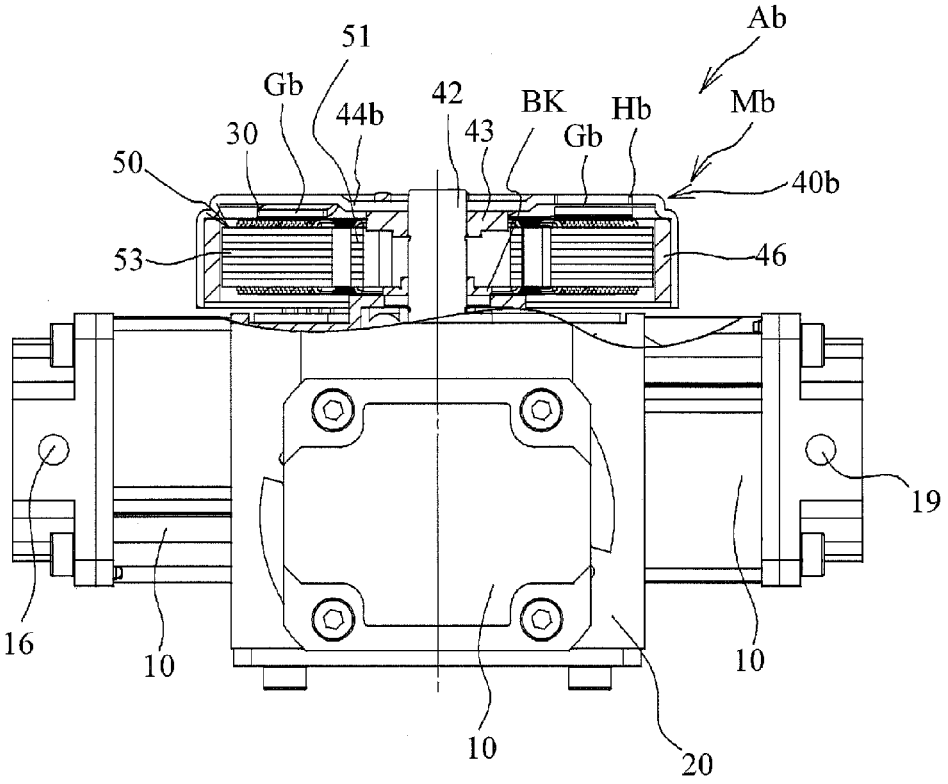
FIG. 8 is a sectional view of the compressor according to the third embodiment.

A compressor Ab according to a third embodiment will be described. Additionally, similar components of the compressor Aa according to the second embodiment are designated with similar reference numerals and a description of those components will be omitted. FIG. 7 is an external view of the compressor Ab according to the third embodiment. FIG. 8 is a sectional view of the compressor Ab according to the third embodiment.

Guide portions Gb protrude toward the stator 50. That is, the guide portions Gb protrudes into a motor Mb. The rotation of such a yoke 44*b* assists air in flowing through the motor Mb, thereby cooling the cylinders 10 and the crankcase 20. Also, for example, in a case where the compressor Ab is used in a manner that a user can touch the motor Mb, the compressor Ab is suitable.

Additionally, like the first embodiment, the stator 50 of the motor Mb is supported by and fitted with the bracket BK of the crankcase 20. However, unlike the first embodiment, air flows through the bracket BK from the cylinders 10 and the crankcase 20 and is discharged from air holes Hb. Moreover, the third embodiment may be provided with the fan F. In this case, the cylinders 10 and the crankcase 20 can be further cooled. Also, only one of the inside fan and the outside fan may be provided. Both the inside fan and the outside fan separately formed may be provided.

While the exemplary embodiments of the present invention have been illustrated in detail, the present invention is not limited to the above-mentioned embodiments, and other embodiments, variations and modifications may be made without departing from the scope of the present invention.

The number of the cylinders is not limited to four.

What is claimed is:

1. A compressor comprising:
a cylinder;
a crankcase;
a piston arranged within the cylinder and the crankcase;
an outer rotor type motor causing the piston to reciprocate; and
a printed circuit board arranged between the crankcase and the outer rotor type motor, wherein at least a part of the printed circuit board is exposed to an outside, and
wherein
the outer rotor type motor comprises:
a stator;
a coil wound around the stator;
a rotational shaft;
a yoke connected with the rotational shaft, the yoke is secured to a fan facing the yoke and at least a part of the cylinder, and wherein a part of the fan is arranged radially outward of the yoke; and
a permanent magnet secured to the yoke,
the yoke is formed with an air hole, the fan assisting air in flowing through the air hole, wherein the fan comprises a plurality of blades, and wherein at least a part of the air hole is exposed between the plurality of blades.

2. The compressor of claim 1, wherein the yoke is formed with a guide portion standing up from an edge of the air hole and assisting air in flowing through the air hole.

3. The compressor of claim 2, wherein the guide portion protrudes toward an opposite side of the stator.

4. The compressor of claim 2, wherein the guide portion protrudes toward the stator.

5. The compressor of claim 1, wherein
the stator is supported by and fitted with a fitting portion formed in the crankcase and is located between the yoke and the crankcase, and
the fitting portion is formed with a cutout portion permitting air to flow between the yoke and the crankcase.

6. A vacuum machine comprising:
a cylinder;
a crankcase;
a piston arranged within the cylinder and the crankcase;
an outer rotor type motor causing the piston to reciprocate; and
a printed circuit board arranged between the crankcase and the outer rotor type motor, wherein at least a part of the printed circuit board is exposed to an outside, and
wherein
the outer rotor type motor comprises:
a stator;
a coil wound around the stator;
a rotational shaft;
a yoke connected with the rotational shaft, the yoke is secured to a fan facing the yoke and at least a part of the cylinder, and wherein a part of the fan is arranged radially outward of the yoke; and
a permanent magnet secured to the yoke,
the yoke is formed with an air hole, the fan assisting air in flowing through the air hole, wherein the fan comprises a plurality of blades, and wherein at least a part of the air hole is exposed between the plurality of blades.

7. The vacuum machine of claim 6, wherein the yoke is formed with a guide portion standing up from an edge of the air hole and assisting air in flowing through the air hole.

8. The vacuum machine of claim 7, wherein the guide portion protrudes toward an opposite side of the stator.

9. The vacuum machine of claim 7, wherein the guide portion protrudes toward the stator.

10. The vacuum machine of claim 6, wherein
the stator is supported by and fitted with a fitting portion formed in the crankcase and is located between the yoke and the crankcase, and the fitting portion is formed with a cutout portion permitting air to flow between the yoke and the crankcase.

* * * * *